US006083100A

United States Patent [19]

Hardy et al.

[11] Patent Number: 6,083,100

[45] Date of Patent: Jul. 4, 2000

[54] UNDERFLOOR AIR DIFFUSER ASSEMBLY

[75] Inventors: Thomas Ray Hardy, Canton; Kenneth Loudermilk, Duluth, both of Ga.; Hans Riegel, Geldern, Germany; Michael Fey, Hilden, Germany; Thomas Sefker, Neukirchen-Vluyn, Germany

[73] Assignee: Gebruder Trox GmbH, Germany

[21] Appl. No.: 09/246,052

[22] Filed: Feb. 8, 1999

[51] Int. Cl.[7] ..... F24F 13/06

[52] U.S. Cl. ..... 454/290; 454/323

[58] Field of Search ..... 454/289, 290, 454/309, 310, 312, 323

[56] References Cited

U.S. PATENT DOCUMENTS

| | | | |
|---|---|---|---|
| 4,549,474 | 10/1985 | Fey et al. | 454/289 |
| 5,058,490 | 10/1991 | Sodec et al. | 454/289 |
| 5,163,871 | 11/1992 | Huibregtse et al. | 454/289 |
| 5,338,256 | 8/1994 | Tonna | 454/310 |
| 5,472,380 | 12/1995 | Sarazen, Jr. et al. | 454/290 |
| 5,551,915 | 9/1996 | Schweikert | 454/290 |
| 5,556,330 | 9/1996 | Schweikert | 454/289 |
| 5,607,354 | 3/1997 | Mill et al. | 454/310 |
| 5,910,045 | 6/1999 | Aoki et al. | 454/186 |
| 5,938,525 | 8/1999 | Birdsong et al. | 454/290 |

*Primary Examiner*—Denise L. Ferensic
*Assistant Examiner*—Alein Cadalso
*Attorney, Agent, or Firm*—William B. Noll

[57] ABSTRACT

An air diffuser assembly for use in combination with an underfloor air distribution system, where the system includes in part a cavity under a floor, having an upper surface, transmitting air under pressure to selected locations above the floor. The air diffuser assembly comprises first and second annular rings threadably engaging one another and secured respectively to above and below the floor, where the first annular ring includes an annular shoulder for receiving a grill assembly. The grill assembly is seated on the shoulder and is in communication with the space above the upper surface. The grill assembly further includes a centrally disposed, downwardly extending, vertically adjustable rod mounting a circular basket at its free end. The basket includes an array of through holes for delivering pressurized air from the underfloor cavity to the diffuser assembly, and means, such as a rod, connecting the basket to the grill assembly to prevent rotation of the basket. Finally, plural, radially extending, fixed vanes are provided and secured about the vertically adjustable rod to discharge air under pressure from the basket and defined sub-chamber to the space above the upper surface to impart a radial spin to the discharged air.

3 Claims, 2 Drawing Sheets

UNDERFLOOR AIR DIFFUSER ASSEMBLY

FIELD OF THE INVENTION

This invention is directed to the field of underfloor air distribution systems, more particularly to an air diffuser assembly having a vertically adjustable plenum, a grill, adjustable air fins to impart a radial spin to the discharged air stream, and a removable dirt basket.

BACKGROUND OF THE INVENTION

The present invention relates to an underfloor air distribution system for heating and air conditioning, especially for use in an open space office complex. This is in stark constrast to the traditional overhead ventilation systems that are not easily adapted to changes or reconfiguration of office space.

Most large office buildings constructed in the past ten years consist of individual offices preferably along all of the building facade surrounding a large open interior office space. Interior offices are created using acoustical partitions and modular furniture, which may be easily relocated to reconfigure the office space in accordance with occupancy or process demands. The prominent detriment to reconfiguration is usually the relocation of electrical and mechanical services. Electrical services include power and communication transmission cables and their receptacles, while mechanical systems refer primarily to the air conditioning and ventilation systems.

Several construction methods have been developed to allow relocation of electrical services in the open office enviroment. All of these systems, as known in the art, depend on placement of the outlets within the floor plane.

The use of raised access floors in office space applications is rapidly gaining popularity. These systems allow power and communications wiring to be located in an easily accessible cavity below the office floor. In addition, the cavity may be used for the supply of conditioned air to the office space, eliminating most of the ductwork and insulation requirements that are inherent to overhead systems.

Underfloor air delivery systems are now becoming popular with the business community and developers due primarily to economics. Underfloor air systems, as presently known, deliver air to large zoning plenums via air terminals mounted in a floor cavity. Air is delivered to the occupants, such as employees, by means of high induction floor outlets that are tapped directly into the pressurized floor plenum.

The present invention differs from existing floor diffuser assemblies by the combination and use of adjustable components. The manner by which this combination is constructed, and the many advantages to be gained thereby, will become apparent to those skilled in the art from the following description, particularly when read in conjunction with the accompanying drawings.

SUMMARY OF THE INVENTION

This invention relates to an air diffuser assembly for use in combination with an underfloor air distribution system, where the system includes in part a cavity or plenum under a floor, having an upper surface, transmitting air under pressure to selected locations above the floor. The assembly hereof is designed to be easily positioned at one or more of the selected locations. The air diffuser assembly comprises first and second annular ring members threadably engaging one another, and secured, respectively, to above and below the floor. The first or upper annular ring member includes an inwardly directed annular shoulder for receiving a grill assembly. The grill assembly, including a grill having concentric arcuate slots, is seated on said shoulder and is in communication with the space above said upper surface. The grill assembly fiber includes a centrally disposed, downwardly extending, vertically adjustable rod mounting a circular dirt basket at its lower or free end. The basket includes an array of through holes for delivering pressurized air from the underfloor cavity or plenum to the diffuser assembly. Further, means are provided, such as a rod, for connecting the basket to the grill assembly to prevent rotation of the basket. Finally, plural, radially extending, adjustable vanes are provided and fixedly secured about the vertically adjustable rod to discharge air under pressure from the basket to the space above the floor surface to impart a radial spin to the discharged air.

Accordingly, an object of this invention is to provide an improved underfloor air diffuser assembly by incorporating adjustable components for enhanced performance.

A further object hereof is the provision of radially extending vane arms that may be selectively angled off the horizontal to impart a radial spin to the air stream discharged through the vane arms.

Another object of the invention lies in the design and construction of a grill assembly that can be removed without disturbing the adjoining flooring material, such as carpeting or floor tile.

A further object hereof is the provision of a vertically adjustable dirt basket that can be removed and cleaned without disturbing the position of the assembly's volume control damper, thus affecting the preset airflow delivery.

Still another object of this invention lies in the use of a calibrated member which visually indicates the percentage of opening represented by the volume damper position, where such member may include physical stops to limit field adjustments between a maximum and a minimum.

Finally, another object is the ability to modify the air discharge pattern in the field, without removing or adding any ancillary components.

These and other objects will become apparent from a reading of the following specification, particularly by those skilled in the art.

DETAILED DESCRIPTION OF PREFERRED EMBODIMENT

Figure 1:
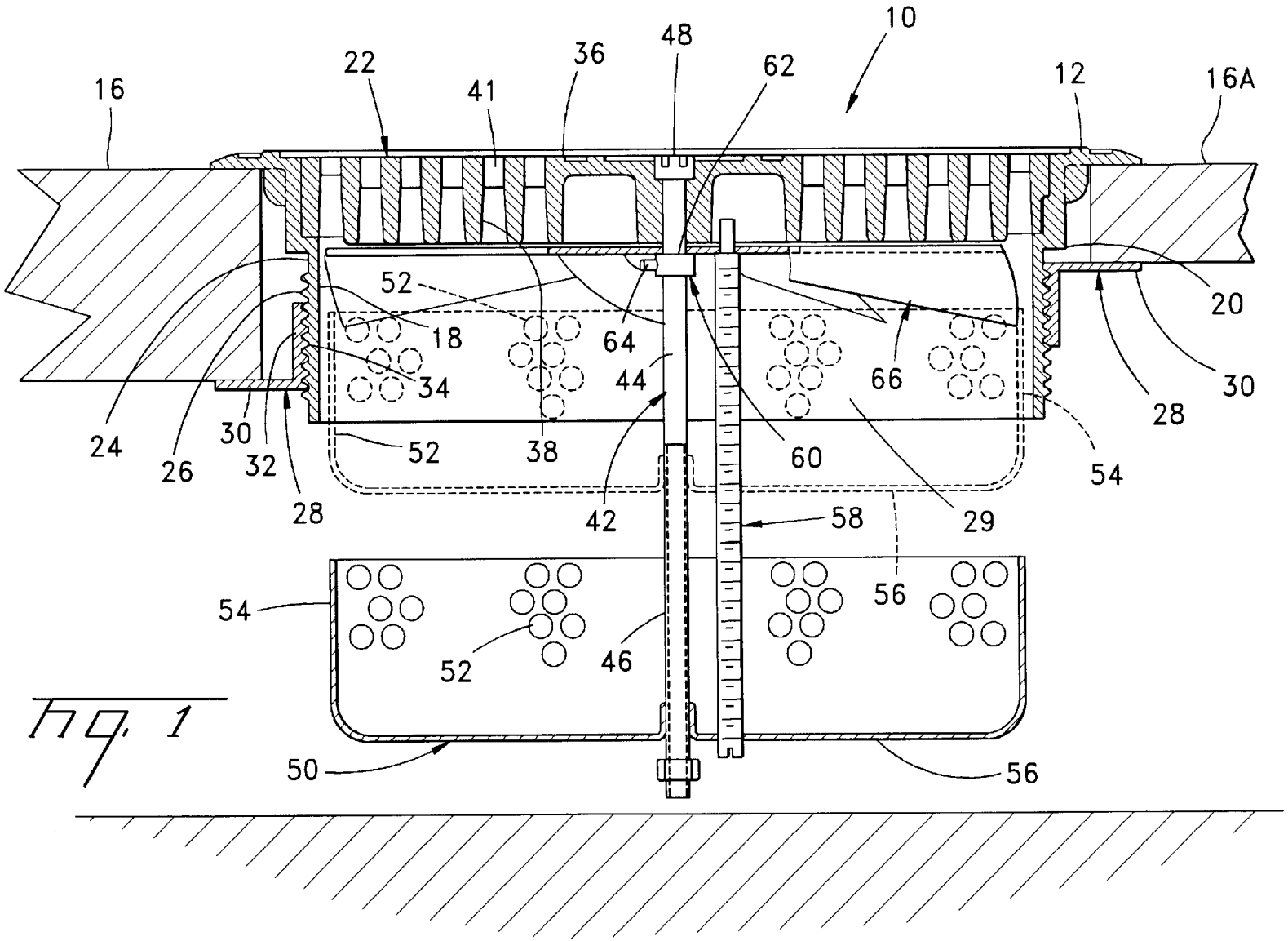
FIG. 1 is a sectional view of the underfloor air diffuser assembly according to this invention, showing among other features the variability of the assembly for mounting to different thickness floors.

This invention is directed to an improved underfloor air distribution system that incorporates an air diffuser assembly having a vertically adjustable and removable dirt basket, and adjustable fixed vanes to impart a radial spin to the discharged air stream. Such a system offers distinct advantages over a traditional air ventilation system that is often limited in its flexibility in ventilating interior spaces.

Underfloor air distribution systems have become a new office design technique because it overcomes the limitations of traditional overhead systems. By way of background, a brief look at an underfloor or access floor system may be helpful in further understanding this invention.

A raised access floor system consists of a rigid structural grid that supports lay-in floor panels. These floor panels are typically 1 to 1½ inches thick and constructed of reinforced steel or concrete-like material. They are supported such that the resultant floor level is usually 8 to 12 inches above the actual slab. This creates a cavity in which all power supply, data, and communication cables may be located. These cables are routed via modular connections to floor or system furniture panel outlet boxes. Space changes can be easily accomplished by simply relocating floor panels and adding or deleting modular sections of cable. Floor air diffusers may be ducted but are typically mounted directly into the floor panels and supply conditioned air directly from the pressurized floor plenum or cavity to the space. This allows the diffusers to be easily moved as well by simply relocating the floor panel in which they are mounted.

The invention hereof offers an improved air diffuser assembly, as illustrated in the several Figures, where like reference numerals represent like components or features throughout the various views.

Figure 2:
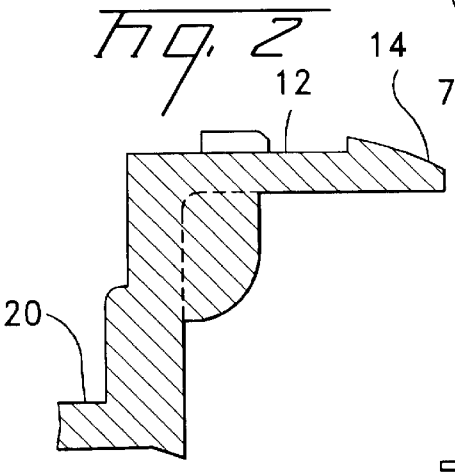
FIG. 2 is an enlarged sectional view taken through the upper annular ring member which exhibits an inwardly directed annular shoulder for receiving a grill assembly.

Turning now to the several Figures, FIG. 1 illustrates the underfloor air diffuser assembly 10 of this invention, as positioned in an access floor in communication with the cavity under the floor. The air diffuser assembly 10 comprises an upper, circular, annular member 12, note further FIG. 2, having an outwardly extending flange 14 to overlie the office floor 16, 16A, for example. For purposes of illustration, different floor thicknesses are shown to illustrate the capability of the air diffuser assembly 10 to accommodate a range of floor thicknesses. In any case, the upper annular member 12 includes a downwardly projecting annular wall 18 having an inwardly extending shoulder 20 to receive a grill assembly 22, as hereinafter described. Further, the outer wall 24 of annular wall 18 includes a continuous threaded rib 26. Cooperating with the upper, circular annular member 12, is a complementary, lower annular member 28. The lower member 28, L-shaped in cross section, is characterized by an outwardly projecting flange 30 and an upwardly extending annular wall 32, where said wall 32 includes a continuous threaded rib 34 for threadably engaging threaded rib 26 of the upper member 12. By this arrangement the respective members 12, 28 are threadably engaged until secured to the office floors 16, 16A, in a clamp like fashion, see FIG. 1, and define a sub-chamber 29 for receiving a dirt basket, as hereinafter explained.

Figure 3:
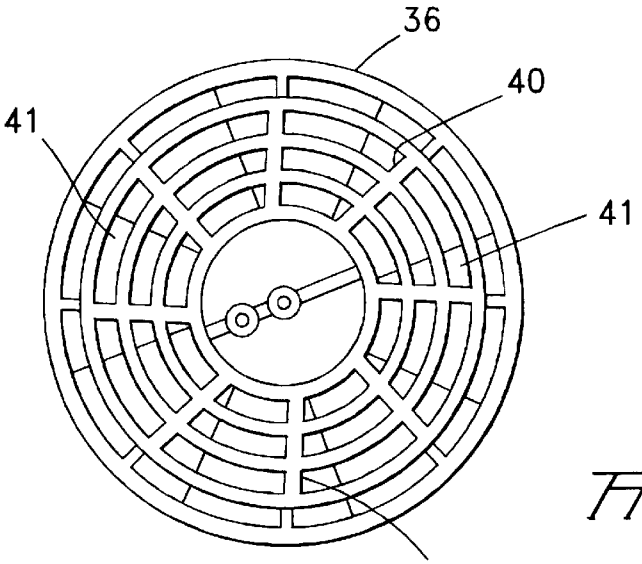
FIG. 3 is a top plan view of an exemplary circular grill forming a part of the grill assembly.
Figure 4:
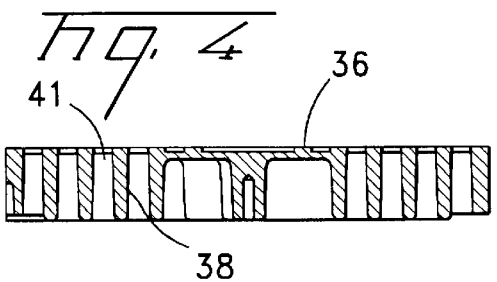
FIG. 4 is a sectional view of the circular grill of FIG. 3.

Removably received within the upper member 12 is the grill assembly 22. The grill assembly 22 comprises a circular grill 36, see FIG. 3, diametrically sized for sliding receipt on internal shoulder 20. The grill assembly 22 is characterized by grating walls 38, where said walls 38 are joined by radial webs 40, and circumferentially spaced apart by concentrically arranged arcuate trough slots 41. In a preferred embodiment the grill pattern consists of a series of at least four concentric or arcuate airflow passages, preferably subdivided into at least six radial discharge quadrants by webs 40. This results in the subdivision of the supplied airflow into at least twenty four distinct air jets. This design increases the surface area of the supply air jets, thus enhancing the assembly's capability of mixing the conditioned air with office air very near the grill face. In any case, the preferred grill assembly 22 further comprises a downwardly extending, centrally positioned telescopic rod 42, rotatably positioned within the circular grill 36, where the telescoping sections 44, 46 threadably engage, as known in the art, to vertically raise or lower section 46. Such movement may be effected by a hand tool "T," for example, inserted into slot 48.

Mounted at the lower or free end of rod section 46 is a circular dirt basket 50 having an array of through holes 52 about the side wall 54, where the base 56 is solid to collect dirt and other debris that may enter the assembly. By simply rotating the hand tool, an operator can raise the dirt basket 50 from the lowermost position shown in FIG. 1, to the uppermost position shown in phantom lines, or vise versa. By this convenient external means, such operator can make field adjustments to the outlet airflow delivery. That is, adjustment of the airflow delivery is dampered by means of the adjustment mechanism in the grill face, such as by a hand tool inserted into slot 48. For example, this mechanism can be rotated in a clockwise direction to reduce the delivered airflow, or in a counterclockwise direction to increase the airflow. That is, as the dirt basket 50 is "screwed" up into the sub-chamber 29, the "free" area between the basket 50 and the grill 36 is reduced, thereby reducing the air being discharged through the grill 36. The main reduction or throttling occurs when the basket 50 enters the sub-chamber 29, thereby closing off the array of holes 52 about the basket side wall 54.

Another feature of the grill assembly 22 is a calibrated rod 58 extending from the grill 36 to a position below the lowermost position for the dirt basket 50. The rod 58 is calibrated with indicia to indicate varying degrees between a maximum position to a minimum position to visually identify the percentage of opening for the volume damper, or varying positions in between as the basket is moved. Optionally, physical stops in the form of rings may be included on the rod 58 to limit field adjustments of the volume damper between the maximum and minimum positions.

Figure 5:
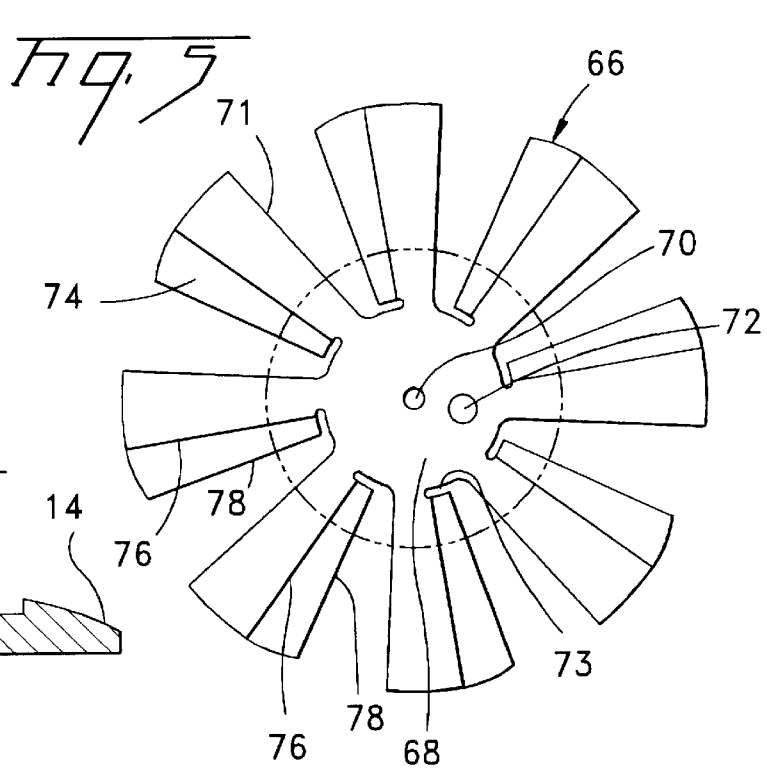
FIG. 5 is atop plan view of an exemplary vane member having plural, radially projecting vane arms extending from a common center portion.
Figure 6:
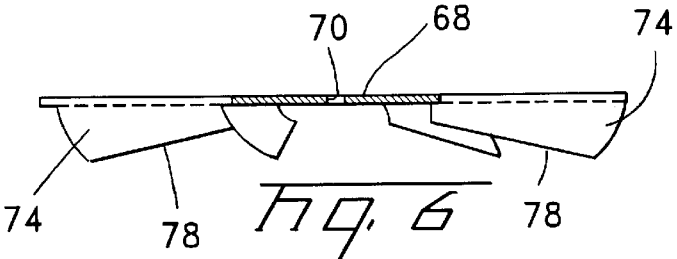
FIG. 6 is a sectional view of the vane member of FIG. 5, showing the angular orientation of the vane arms.

One such stop 60, in the form of a ring 62 having a radial tightening screw 64, is shown in FIG. 1 as a means to fixedly position a vane member 66, see FIGS. 5 and 6. Such Figures illustrate an exemplary vane member 66, where such member may be stamped and/or molded from a planar sheet, such as a corrosion resistant and aesthetically pleasing material, like aluminum, brass, or plastic. The vane member 66 includes a planar center portion 68 with a central aperture 70 for mounting the vane member 66 on rod section 44 and secured by stop 60. Additionally, offset from central aperture 70 is a second aperture 72 which is slidably received on calibrated rod 58, whereby to fix the vane member 66 relative to the grill 36. Projecting from the center portion 68 are plural radial arms 71 which feature an arcuate slot 73, where the plural slots are circumferentially aligned, see FIG. 5. Extending radially from the outer edge 74 to the arcuate slot 73, for each said arm 71, is a score line 76. By this arrangement, the radial edge 78 may be bent at an angle, preferably between about 20 to 45 degrees, note FIG. 6. Briefly, the arms 71 lie in a horizontal plane, while the outer edges 74 thereof are angled downward at the selected angle. The arms, when angled at a minimum angle of 20 degrees off the horizontal, impart a radial spin to the discharged air stream as the air passes therethrough.

It is recognized that modifications, changes and additions may be made to the components of the underfloor diffuser assembly of this invention, such as in the selection of materials. Typically, since the respective components are exposed to conditioned air, and through the various floor locations where conditioned air is required, preferred classes of materials are those which exhibit a corrosion resistant quality, such as brass, aluminum and plastics. However, other materials may also be suitable. Accordingly, no limitation is intended to be imposed on this invention, except as set forth in the following claims.

What is claimed is:

1. An air diffuser assembly for use in combination with an underfloor air distribution system, where said system includes in part a cavity under a floor, having an upper surface, for transmitting air under pressure to selected locations above said floor, said air diffuser assembly comprising:

a.) first and second annular rings threadably engaging one another and secured respectively to above and below said floor, where said first annular ring includes an annular shoulder;

b.) a grill assembly seated on said shoulder in communication with the space above said upper surface, where said grill assembly includes a centrally disposed downwardly extending vertically adjustable rod mounting a circular basket at its free end, wherein external means are provided to raise and lower said circular basket to precisely control airflow from said air diffuser assembly;

i.) said circular basket including an array of through holes for delivering pressurized air from said cavity to said diffuser assembly; and ii.) means connecting said basket to said grill assembly to prevent rotation of said basket; and c.) plural, radially extending vanes secured about said vertically adjustable rod to direct air under pressure from said basket to the space above said upper surface to impart a radial spin to said discharged air.

2. An air diffuser assembly for use in combination with an underfloor air distribution system, where said system includes in part a cavity under a floor, having an upper surface, for transmitting air under pressure to selected locations above said floor, said air diffuser assembly comprising:

a.) first and second annular rings threadably engaging one another and secured respectively to above and below said floor, where said first annular ring includes an annular shoulder;

b.) a grill assembly seated on said shoulder in communication with the space above said upper surface, where said grill assembly includes a centrally disposed downwardly extending vertically adjustable rod mounting a circular basket at its free end, wherein means are provided to remove said circular basket for maintenance purposes without disturbing the preselected setting for the airflow from said air diffuser assembly;

i.) said circular basket including an array of through holes for delivering pressurized air from said cavity to said diffuser assembly; and ii.) means connecting said basket to said grill assembly to prevent rotation of said basket; and c.) plural, radially extending, vanes secured about said vertically adjustable rod to direct air pressure from said basket to the space above said upper surface to impart a radial spin to said discharged air.

3. An air diffuser assembly for use in combination with an underfloor air distribution system, where said system includes in part a cavity under a floor, having an upper surface, for transmitting air under pressure to selected locations above said floor, said air diffuser assembly comprising:

a.) first and second annular rings threadably engaging one another and secured respectively to above and below said floor, where said first annular ring includes an annular shoulder;

b.) a grill assembly seated on said shoulder in communication with the space above said upper surface, where said grill assembly includes a centrally disposed downwardly extending vertically adjustable rod mounting a circular basket at its free end;

i.) said circular basket including an array of through holes for delivering pressurized air from said cavity to said diffuser assembly; and ii.) means connecting said basket to said grill assembly to prevent rotation of said basket, where said means comprises a fixed elongated member along which said basket rides, and which includes linear indicia thereon to indicate a percentage airflow for said air diffuser assembly; and c.) plural, radially extending, vanes secured about said vertically adjustable rod to direct air under pressure from said basket to the space above said upper surface to impart a radial spin to said discharged air.

* * * * *